US007051958B2

(12) United States Patent
Potz et al.

(10) Patent No.: US 7,051,958 B2
(45) Date of Patent: May 30, 2006

(54) FUEL INJECTION VALVE FOR INTERNAL COMBUSTION ENGINES

(75) Inventors: Detlev Potz, deceased, late of Stuttgart (DE); by Maike Sander-Potz, legal representative, Stuttgart (DE); by Wendelin Potz, legal representative, Stuttgart (DE); Peter Boehland, Marbach (DE); Thomas Kuegler, Korntal-Muenchingen (DE); Andreas Koeninger, Neulingen-Goebrichen (DE); Predrag Nunic, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 153 days.

(21) Appl. No.: 10/474,681

(22) PCT Filed: Jan. 27, 2003

(86) PCT No.: PCT/DE03/00210

§ 371 (c)(1),
(2), (4) Date: Oct. 14, 2003

(87) PCT Pub. No.: WO03/069151

PCT Pub. Date: Aug. 21, 2003

(65) Prior Publication Data

US 2004/0129804 A1 Jul. 8, 2004

(30) Foreign Application Priority Data

Feb. 14, 2002 (DE) ..... 102 05 970

(51) Int. Cl.
*F02M 56/00* (2006.01)
*F02M 61/00* (2006.01)
*F02M 63/00* (2006.01)

(52) U.S. Cl. ..... 239/533.2; 239/585.1; 239/585.5

(58) Field of Classification Search ..... 239/533.2, 239/585.1, 585.5
See application file for complete search history.

(56) References Cited

U.S. PATENT DOCUMENTS 6,378,503 B1 * 4/2002 Lambert ..... 123/468
6,471,142 B1 * 10/2002 Lambert ..... 239/88
6,557,779 B1 * 5/2003 Perr et al. ..... 239/96
6,691,934 B1 * 2/2004 Egler et al. ..... 239/533.2
6,725,841 B1 4/2004 Boecking (Continued)

FOREIGN PATENT DOCUMENTS

DE 198 34 867 A1 2/1999

(Continued)

*Primary Examiner*—David A. Scherbel
*Assistant Examiner*—James S. Hogan
(74) *Attorney, Agent, or Firm*—Ronald E. Greigg

(57) ABSTRACT

A fuel injection valve for internal combustion engines, having a housing in which an outer valve needle and an inner valve needle guided in it are disposed in a bore. The outer valve needle controls an outer row of injection openings, and the inner valve needle controls an inner row of injection openings, to which rows of injection openings fuel is delivered at an injection pressure through a high-pressure conduit embodied in the housing. A control pressure chamber in the housing can be made to communicate with the high-pressure conduit, and by means of its pressure, a closing force is exerted at least indirectly on the inner valve needle. The high-pressure conduit communicates with a control chamber, by whose pressure a closing force is exerted at least indirectly on the outer valve needle, and the control chamber communicates with the control pressure chamber. A control valve is disposed in a housing, and by means of the control valve, the control chamber can be made to communicate with a leak fuel chamber.

11 Claims, 4 Drawing Sheets

U.S. PATENT DOCUMENTS

| | | | | |
|---|---|---|---|---|
| 6,776,354 | B1 * | 8/2004 | Cooke | 239/102.2 |
| 2003/0168528 | A1 * | 9/2003 | Egler et al. | 239/533.2 |

FOREIGN PATENT DOCUMENTS

| | | | |
|---|---|---|---|
| DE | 100 38 054 | A1 | 2/2001 |
| DE | 199 49 528 | A1 | 4/2001 |
| EP | 0 878 623 | A2 | 11/1998 |
| EP | 0 978 649 | A2 | 2/2000 |
| EP | 1 069 308 | A2 | 1/2001 |
| WO | WO 02/090754 | A1 | 11/2002 |

* cited by examiner

FUEL INJECTION VALVE FOR INTERNAL COMBUSTION ENGINES

CROSS-REFERENCE TO RELATED APPLICATIONS

This application is a 35 USC 371 application of PCT/DE 03/00210 filed on Jan. 27, 2003.

BACKGROUND OF THE INVENTION

1. Field of the Invention

The invention is directed to an improved fuel injection valve for internal combustion engines.

2. Description of the Prior Art

One fuel injection valve known for instance from published, nonexamined German patent application DE 41 15 477 A1 includes an outer valve needle and an inner valve needle guided in it are located in a housing. Both valve needles cooperate, by their end toward the combustion chamber, with a valve seat face in which there are two rows of injection openings. The outer row of injection openings is controlled by the outer valve needle, and the inner row of injection openings is correspondingly controlled by the inner valve needle. Through a high-pressure conduit embodied in the housing, the injection openings are supplied with fuel at high pressure, which emerges, controlled by the valve needles, through the injection openings and from there is injected into the combustion chamber of the engine.

A control chamber is embodied in the housing of the fuel injection valve, and its pressure acts on the face end of a pressure piston which is connected to the inner valve needle. In this way, via the pressure in the control chamber, a closing force on the inner valve needle is produced, which keeps this valve needle in contact with the valve seat face. The control chamber can communicate with the injection pressure via a control valve, or can be relieved into a leak fuel chamber, so that the pressure in the control chamber can be controlled in this way. The opening pressure on the inner and outer valve needles is generated, in this known valve by the imposition of fuel pressure on a pressure face, embodied on each of the valve needles; the pressure at which the valve needles open is called the opening pressure.

The known fuel injection valve has the disadvantage, however, that the closing force on the outer valve needle is not generated hydraulically but rather via a fixedly prestressed closing spring. The opening pressure of the outer valve needle is therefore not regulatable, and it can be injected through the outer row of injection openings only at a minimum pressure equivalent to the opening pressure of the outer valve needle. Moreover, the prior art has the disadvantage that the control valve that regulates the pressure in the control chamber is embodied as a 3/2-way valve with a slide seat, so that it is relatively complicated and hence expensive to produce. It is thus not possible in the known fuel injection valve to control the injection cross section arbitrarily.

SUMMARY AND ADVANTAGES OF THE INVENTION

The fuel injection valve of the invention has the advantage over the prior art that both the inner and the outer valve needle can be triggered via only a single control valve. A control chamber is embodied in the housing and communicates with the high-pressure conduit and furthermore with a control pressure chamber. Through the pressure in the control chamber, a closing force is exerted at least indirectly on the outer valve needle. In the housing, there is a control valve by which the control chamber can be made to communicate with a leak fuel chamber, so that the pressure in the control chamber and, because of the communication with the control chamber, in the control pressure chamber as well can be lowered to markedly below the injection pressure via the control valve, so that the closing force on the inner and outer valve needle can be controlled. Via a suitable switching characteristic of the control valve and suitably dimensioned inlets and outlets from the control chamber and of its communication with the control pressure chamber, a separate triggering of the outer valve needle, or selectively of both valve needles, can be achieved.

In an advantageous feature of the subject of the invention, the control valve has a valve chamber, which communicates with the control chamber, and also has a valve member, which is controlled by an actuator. The actuator is advantageously embodied as an electric actuator and in particular as a piezoelectric actuator. As a result, the valve member can be controlled precisely, and the valve member can be moved directly to the desired position.

In a further advantageous feature, in a first switching position, the valve member cooperates with a first valve seat, and in a second switching position it cooperates with a second valve seat; in the first switching position, the valve chamber is sealed off from the leak fuel chamber, and in the second switching position it communicates with the leak fuel chamber. By means of this valve member, the pressure in the control chamber can be controlled precisely and without any significant time lag.

In a further advantageous feature, the valve chamber of the control valve can be made to communicate with the high-pressure conduit via a connecting conduit, and when the valve member is in contact with the second valve seat, it closes the connecting conduit. Upon relief of the control chamber, the connecting conduit thus becomes inoperative and does not impede the further function of the pressure regulation in the control chamber. Upon actuation of the control valve and upon motion of the valve member toward the first valve seat, the high-pressure conduit is uncovered, and fuel can flow at the injection pressure into the valve chamber and from there into the control chamber. As a result, after the end of the injection, a high pressure is built up very quickly in the control chamber, so that a strong closing force on the outer valve needle and thus also on the inner valve needle results.

In a further advantageous feature, an outer pressure piston is disposed in a housing; it communicates with the outer valve needle, and its end face defines the control chamber. In this way, as a result of the pressure in the control chamber, a hydraulic force on the end face of the outer pressure piston is produced, so that a closing force is exerted on the outer valve needle. Because of the separation of the function of the pressure face subjected to pressure and of the valve needle, the two parts can be optimized separately from one another.

In still another advantageous feature, the outer pressure piston, in the opening stroke motion of the outer valve needle, comes to rest on a wall of the control chamber, interrupting the communication of the control chamber with the high-pressure conduit. As a result, when the fuel injection valve is open, fuel no longer flows into the control chamber, and thus the leak fuel losses of the fuel injection valve are minimized.

In another advantageous feature, the control pressure chamber is embodied in the outer pressure piston and communicates with the control chamber through a bore in the outer pressure piston. This construction allows direct triggering of the inner valve needle, which is located inside the outer valve needle, and furthermore results in a very space-saving construction.

In an advantageous feature, a pressure markedly lower than the injection pressure, this lower pressure preferably being atmospheric pressure, prevails in the leak fuel chamber. The lower the pressure in the leak fuel chamber, the greater are the pressure differences from the injection pressure, so that correspondingly greater forces on the inner and outer valve needle can also be achieved, and hence shorter switching times.

BRIEF DESCRIPTION OF THE DRAWINGS

One exemplary embodiment of the fuel injection valve of the invention is described herein below, with reference to the drawings, in which.

DESCRIPTION OF THE PREFERRED EMBODIMENT

Figure 1:
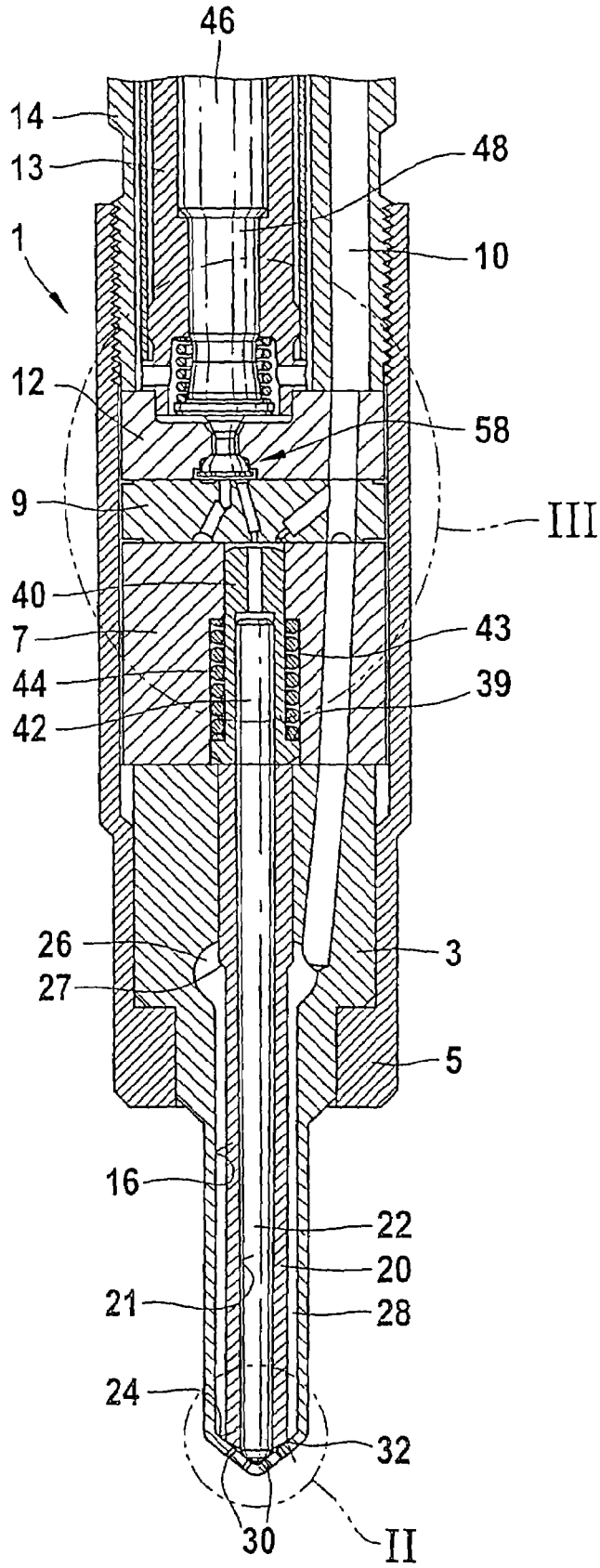
FIG. 1 is a longitudinal section through a fuel injection valve of the invention in its essential region.

In FIG. 1, a longitudinal section is shown through a fuel injection valve of the invention, the fuel injection valve having a housing 1, which has a valve body 3, an intermediate body 7, an intermediate disk 9, a control body 12, and a retaining body 14, with these components each resting on one another in the order recited. All these parts of the housing 1 are pressed against one another by their contact faces by means of a lock nut 5. A high-pressure conduit 10 embodied in the housing 1 communicates with a high-pressure fuel source, not shown in the drawing, and extends as far as the inside of the valve body 3 through the retaining body 14, the control body 12, the intermediate disk 9, and the intermediate body 7. In the valve body 3, the high-pressure conduit 10 discharges into a pressure chamber 26, which is embodied as a radial enlargement of a bore 16 embodied in the valve body 3. The bore 16, on its end toward the combustion chamber, is closed off by a seat face 24, and injection openings 30 are embodied in the seat face 24 that connect the bore 16 to the combustion chamber of the engine. A pistonlike outer valve needle 20 is disposed in the bore 16 and is guided sealingly in a portion of the bore 16 remote from the combustion chamber. Beginning at the guided portion, the outer valve needle 20 tapers toward the combustion chamber, forming a pressure shoulder 27, and on its end toward the combustion chamber it changes into a valve sealing face 32, with which it rests on the seat face 24 in the closing position. An annular conduit 28 is embodied between the outer valve needle 20 and the wall of the bore 16 and connects the pressure chamber 26 to the seat face 24; the pressure shoulder 27 is disposed at the level of the pressure chamber 26. In the closing position, the outer valve needle 20 closes off the injection openings 30 from the fuel in the annular conduit 28, so that only when the outer valve needle 20 has lifted from the seat face 24 can fuel flow to the injection openings 30.

Figure 2:
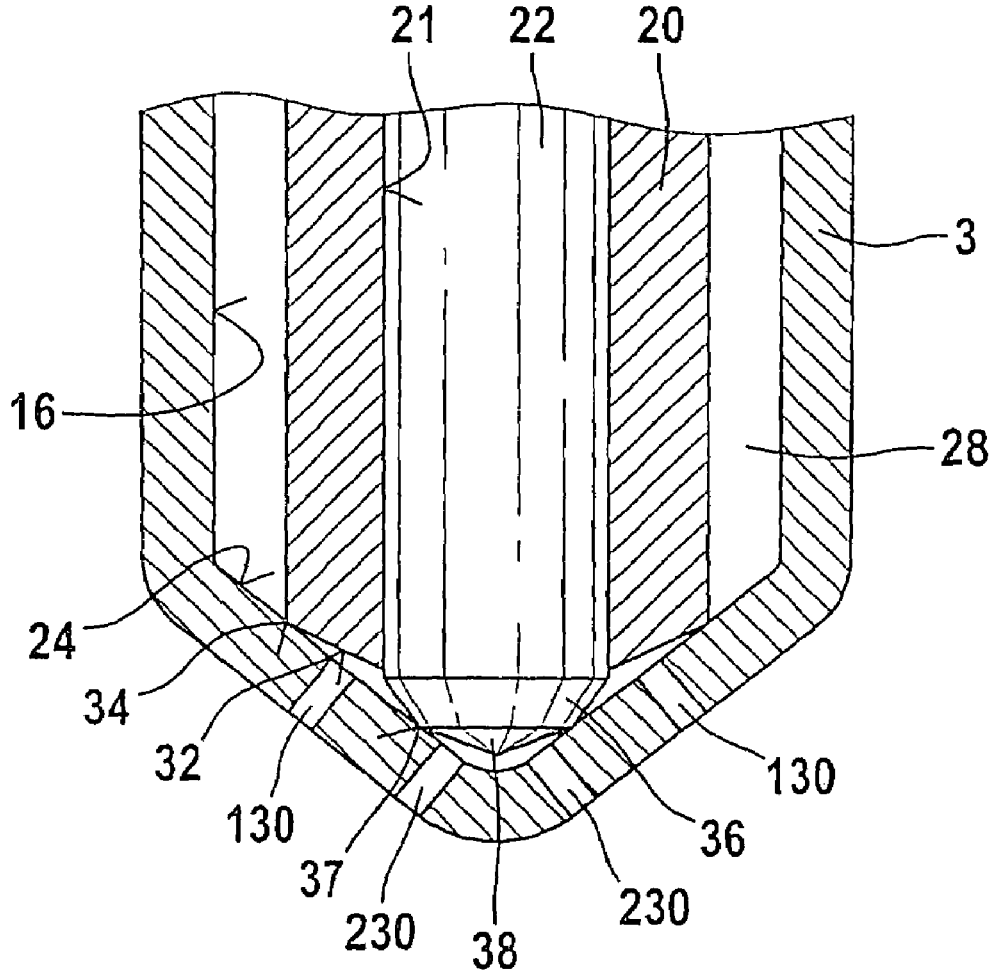
FIG. 2, an enlargement of FIG. 1 in the region of the end toward the combustion chamber of the injection valve, this detail marked II in FIG. 1.

The outer valve needle 20 is embodied as a hollow needle and has a longitudinal bore 21. An inner valve needle 22 is disposed longitudinally displaceably in the longitudinal bore 21, and with its end toward the combustion chamber it also comes to rest, in the closing position, on the seat face 24. FIG. 2 shows an enlargement of the detail marked II in FIG. 1, that is, the region of the seat face 24. The injection openings 30 in the seat face 24 are grouped into one outer row 130 of injection openings and one inner row 230 of injection openings. The outer valve needle 20, on its end toward the combustion chamber, has a conical valve sealing face 32, which has a larger opening angle than the likewise conically embodied seat face 24. As a result, on the outer edge of the sealing face 32, a sealing edge 34 is embodied, which in the closing position of the outer valve needle 20 comes to rest on the seat face 24. The sealing edge 34 is disposed upstream of the outer row 130 of injection openings, so that when the sealing edge 34 is in contact with the seat face 24, the injection openings of the outer row 130 are sealed off from the annular conduit 28. On the end toward the combustion chamber of the inner valve needle 22, a conical pressure face 36 is embodied, which in turn borders on a likewise conical face 38 that forms the end of the inner valve needle 22. At the transition from the pressure face 36 to the conical face 38, a sealing edge 37 is embodied, which in the closing position of the inner valve needle 22 comes to rest on the seat face 24. The contact of the sealing edge 37 is effected here between the outer row 130 and the inner row 230 of injection openings, so that upon contact of the inner valve needle 22 with the seat face 24, only the inner row 230, but not the outer row 130, of injection openings is sealed off from the annular chamber 28.

Figure 3:
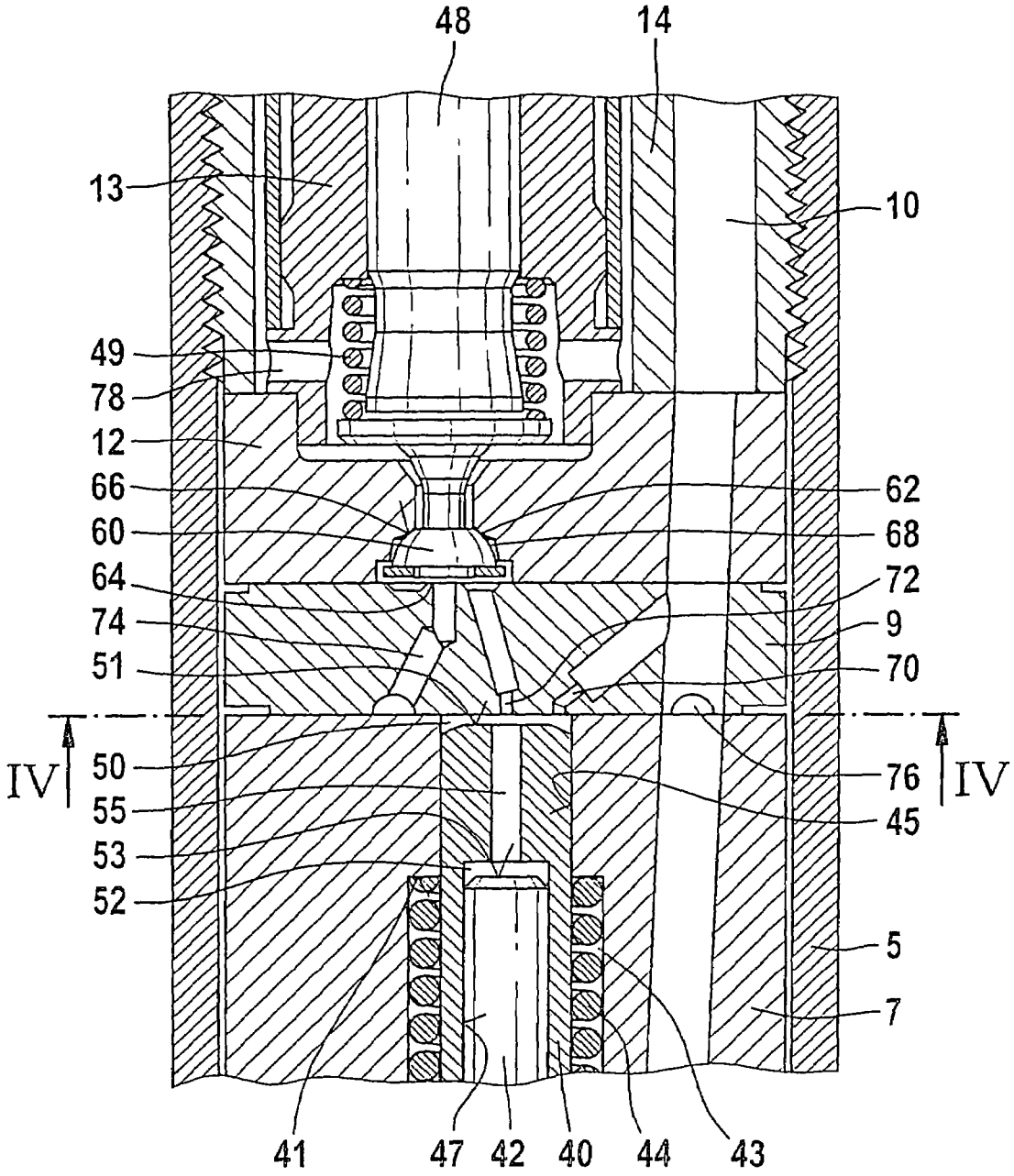
FIG. 3, an enlargement of FIG. 1 in the region marked III.

FIG. 3 shows an enlargement of FIG. 1 in the detail marked III, that is, in the region of the intermediate body 7, intermediate disk 9, and control body 12. A piston bore 45 is disposed in the intermediate body 7, and a pressure piston 40 is disposed in this bore and rests with an end toward the combustion chamber on the outer valve needle 20. By means of a radial enlargement of the piston bore 45, a spring chamber 43 is embodied, in which a closing spring 44, which surrounds the outer pressure piston 40 over part of its length, is disposed with compressive prestressing between a contact face 41 of the spring chamber 43 and an annular face 39 of the outer pressure piston 40. Because of the prestressing of the closing spring 44, the outer pressure piston 40 is pressed in the direction of the valve body 3, and thus the outer valve needle 20 is also pressed in the direction of the seat face 24. A guide bore 47 is embodied in the longitudinal direction in the outer pressure piston 40, and in it an inner pressure piston 42 is guided that rests with its end, toward the combustion chamber, on the inner valve needle 22. The inner pressure piston 42 is longitudinally displaceable in the outer pressure piston 40 and moves synchronously with the inner valve needle 22.

Figure 4:
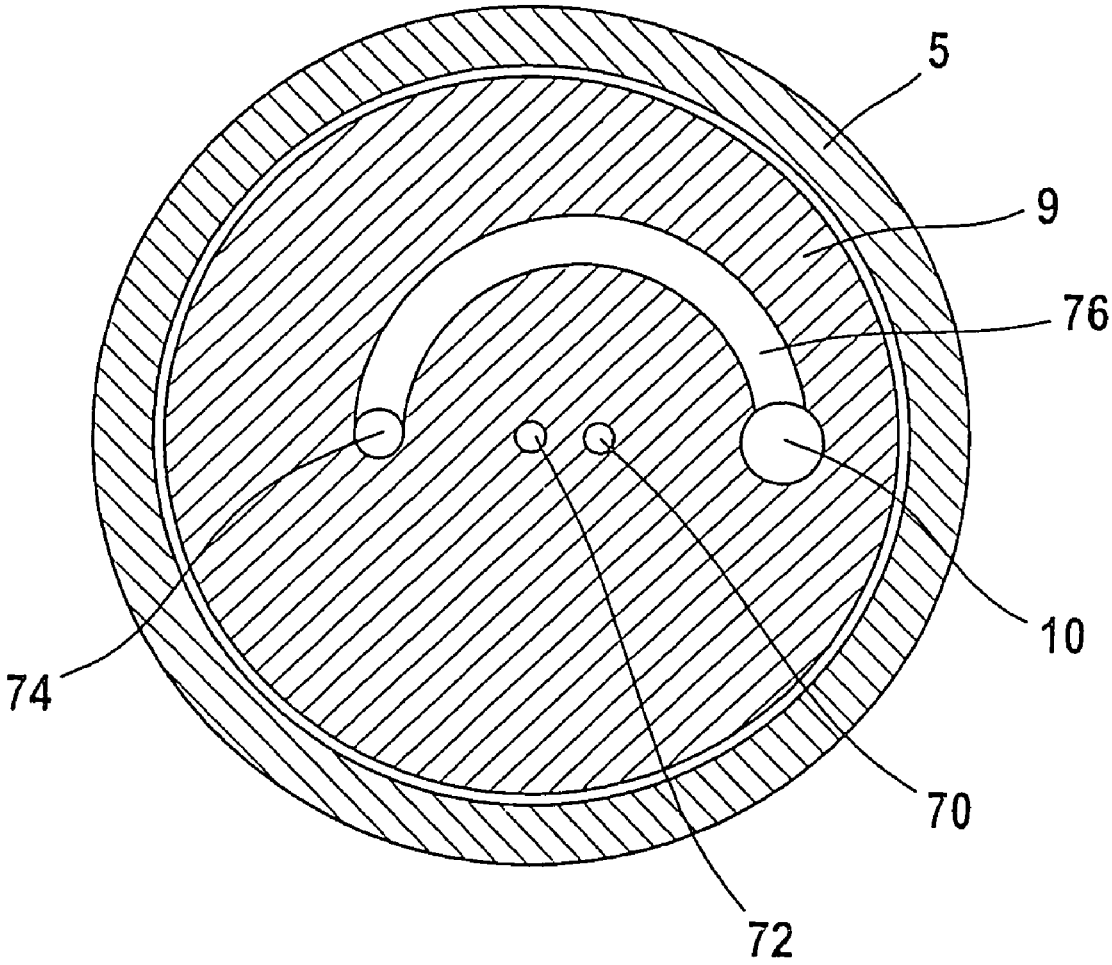
FIG. 4, a cross section through the detail shown in FIG. 3, taken along the line injection IV—IV.

The piston bore 45, face end 51, remote from the combustion chamber, of the outer pressure piston 40, and the intermediate disk 9 define a control chamber 50, which communicates with a control pressure chamber 52 via a connecting bore 55 embodied in the outer pressure piston 40; the control pressure chamber 52 is defined by the guide bore 47 and by the face end 53, remote from the combustion chamber, of the inner pressure piston 42. The control chamber 50 communicates with the high-pressure conduit 10 via an inlet throttle 70 and with a valve chamber 68, embodied in the control body 12, via an outlet throttle 72. A valve member 60 is disposed in the valve chamber 68; it is embodied essentially hemispherically and forms a control valve 58. A flattened side of valve member 60 is oriented toward the intermediate disk 9, while a hemispherical side of the valve member 60 is connected to a pressure piece 48 that is guided in a receiving body 13 disposed in the retaining body 14. The pressure piece 48 is longitudinally displaceable by means of an actuator 46 and as a result also moves the valve member 60 within the valve chamber 68; the actuator is embodied here as a piezoelectric actuator, for example. The pressure piece 48 is surrounded by a leak fuel chamber 78, which because of its communication with a leak fuel system, not shown in the drawing, is always at a low pressure. Remote from the intermediate disk 9 in the valve chamber 68, there is a first valve seat 62, with which the valve member 60 can come into contact with its spherical valve sealing face 66. Opposite the first valve seat 62 in the valve chamber 68, there is a second valve seat 64, with which the valve member 60 can come into contact with its flattened side. A connecting conduit 74, which likewise discharges into the valve chamber 68 and which communicates with the high-pressure conduit 10 via a transverse conduit 76, is closed by contact of the valve member 60 with the second valve seat 64. FIG. 4 shows a cross section through FIG. 3 along the line IV—IV. The course of the transverse conduit 76 as a semicircular groove on the contact face, toward the intermediate body 7, of the intermediate disk 9 is clearly shown here. In the cross section shown, the inlet throttle 70, outlet throttle 72, connecting conduit 74 and high-pressure conduit 10 are also readily visible.

The function of the fuel injection valve is as follows: At the onset of the injection cycle, the fuel injection valve is in the closing position; that is, both the outer valve needle 20 and the inner valve needle 22 are in contact with the seat face 24 and close both the inner row 230 and the outer row 130 of injection openings. Since the valve member 60 is resting on the first valve seat 62, both the control chamber 50 and the control pressure chamber 52 communicate with the high-pressure conduit 10 via the inlet throttle 70, so that in both the control chamber 50 and the control pressure chamber 52, the high fuel pressure of the high-pressure conduit 10 prevails; this pressure is equivalent to the injection pressure. The face end 51 of the outer pressure piston 40 has a larger hydraulically operative face than the pressure shoulder 27 of the outer valve needle 20, so that the outer valve needle 20 remains in the closing position. The force of the closing spring 44 plays only a subordinate role here; the closing spring 44 serves primarily to keep the outer valve needle 20 in the closing position when the engine is not in operation. In the valve chamber 68 as well, because of the communication via the connecting conduit 74 and also via the outlet throttle 72, the pressure in the high-pressure conduit 10 prevails. In the leak fuel chamber 78, conversely, a low pressure prevails, which as a rule is approximately equivalent to atmospheric pressure.

If an injection is to take place, the actuator 46 is actuated, and the valve member 60 moves together with the pressure piece 48 away from the first valve seat 62 toward the second valve seat 64. As a result, the valve chamber 68 is made to communicate with the leak fuel chamber 78, so that the valve chamber 68 and the control chamber 50 as well are pressure-relieved via the outlet throttle 72. By means of the contact of the valve member 60 with the second valve seat 64, the connecting conduit 74 is closed, so that no further fuel can flow into the valve chamber 68 via the transverse conduit 76. The inlet throttle 70 and the outlet throttle 72 are dimensioned such that although the pressure in the control chamber 50 does drop, it does not drop to the level of the leak fuel chamber 78. Because of the dropping pressure in the control chamber 50, the hydraulic force on the face end 51 of the outer pressure piston 40 decreases, so that now the hydraulic force on the pressure shoulder 27 predominates. The outer valve needle 20 thereupon lifts from the seat face 24, and fuel flows out of the annular chamber 28 to the outer row 130 of injection openings, and from there is injected into the combustion chamber of the engine. As a result of the lifting of the outer valve needle 20, the pressure face 36 of the inner valve needle 22 is now also acted upon by fuel, but this force is not sufficient to overcome the hydraulic force on the face end 53 of the inner pressure piston 42, since for that purpose the pressure in the control chamber 50 is still too high. The outer valve needle 20 and the outer pressure piston 40 move away from the combustion chamber until such time as the face end 51 of the outer pressure piston 40 comes to rest on the intermediate disk 9.

When fuel is to be injected into the combustion chamber of the engine through only the outer row 130 of injection openings, for instance for the sake of a pilot injection, then at that instant, the valve member 60 must be moved again by the actuation of the actuator 46, so that the communication between the valve chamber 68 and the leak fuel chamber 78 is interrupted. As a result, the communication between the high-pressure conduit 10 and the valve chamber 68 via the connecting conduit 74 is reestablished, so that fuel flows at injection pressure out of the high-pressure conduit 10 via the outlet throttle 72 and the inlet throttle 70 into the control chamber 50. There, a high fuel pressure level builds up again, which presses the outer pressure piston 40 and thus also the outer valve needle 20 back into the closing position again.

Conversely, if the injection is to be done through the entire injection cross section, that is, through all the injection openings 30, then the valve member 60 remains in contact with the second valve seat 64. Because of the contact of the face end 51 of the outer pressure piston 40 with the intermediate disk 9, the inlet throttle 70 is closed. The pressure in the control pressure chamber 52 can thus drop further via the outlet throttle 72 and the communication of the valve chamber 68 with the leak fuel chamber 78, until the hydraulic force on the pressure face 36 of the inner valve needle 22 is greater than the hydraulic force on the face end 53 of the inner pressure piston 42. The inner valve needle 22, with its sealing edge 37, now lifts from the seat face 24, and fuel is additionally injected through the inner row 130 of injection openings. Here as well, the injection is terminated by actuating the actuator 46, so that the valve member 60 moves back into contact with the first valve seat 62 again. In the manner already described above, high fuel pressure is now once again carried into the control chamber 50 and, via the connecting bore 55, into the control pressure chamber 52 as well. As a result, both the inner valve needle 22 and the outer valve needle 20 close the injection openings 30 off again from the annular conduit 28.

Besides the timing control for opening only the outer row of injection openings, a selective opening can also be attained by means of a middle position of the control valve 58. By means of the piezoelectric actuator 46, the valve member 60 is moved into a middle position between the first valve seat 62 and the second valve seat 64, so that all the connections with the valve chamber 68 are opened. As a result, fuel flows on the one hand out of the valve chamber 68 into the leak fuel chamber 78 and on the other flows constantly into the valve chamber 68 via the connecting conduit 74, so that only a certain pressure drop occurs in the valve chamber 68, but the pressure is still markedly above the pressure in the leak fuel chamber 78. This pressure is sufficient to keep the inner valve needle 22 in its closing position, but the closing force on the outer valve needle 20 has now been reduced to such an extent that the outer valve needle opens. Once again, the injection is terminated as already described above by switching of the control valve 58.

In this exemplary embodiment, the actuator 46 is preferably a piezoelectric actuator. The valve member 60 in the valve chamber 68 requires only a short stroke for its function, of the kind that as a rule can be brought to bear by a piezoelectric actuator. If necessary, a hydraulic booster may be provided, with which longer strokes can be achieved and which is quite well known from the prior art. Furthermore, piezoelectric actuators offer the advantage that they can switch extremely fast. It is thus possible without problems, in the manner described above, to perform a precise preinjection through only the outer row 130 of injection openings.

The foregoing relates to preferred exemplary embodiments in the invention, it being understood that other variants and embodiments thereof are possible within the spirit and scope of the invention, the latter being defined by the appended claims.

The invention claimed is:

1. In a fuel injection valve for internal combustion engines, comprising a housing (1), in which in a bore (16) an outer valve needle (20) and an inner valve needle (22) guided in it are disposed, in which the outer valve needle (20), in a closing position, comes to rest on a valve seat (24) disposed on the end toward the combustion chamber of the housing (1) and by means of a longitudinal motion in an opening direction opens an outer row (130) of injection openings, and the inner valve needle (22) likewise rests on the valve seat (24) in a closing position and by means of a longitudinal motion in an opening direction opens an inner row (230) of injection openings, to which rows (130, 230) of injection openings, in the opened state of the valve needles (20; 22), fuel under pressure flows from a pressure chamber (26) embodied in the housing (1) and from there is injected into the combustion chamber of the engine, a pressure shoulder (27), which is embodied on the outer valve needle (20) and is acted upon by the fuel pressure in the pressure chamber (26), so that as a result, a force acting in the opening direction on the outer valve needle (20) results, a pressure face (36) on the inner valve needle (22), which face, after the outer valve needle (20) has lifted from the valve seat (24), is acted upon by fuel pressure in the opening direction, a high-pressure conduit (10), extending in the housing (1), which discharges into the pressure chamber (26), and in which fuel at high pressure is always present, and having a fuel-filled control pressure chamber (52), whose pressure is controllable and by means of whose pressure, at least indirectly, a closing force is exerted on the inner valve needle (22), a fuel-filled control chamber (50), embodied in the housing (1) by whose pressure, at least indirectly, a closing force is exerted on the outer valve needle (20), an inlet throttle (70), through which the control chamber (50) communicates with the high-pressure conduit (10), an outlet throttle (72), by way of which the control chamber (50) can be made to communicate with a pressureless leak fuel chamber (78), and the outlet throttle (72) is closable by a control valve (58), and the outlet throttle (72) and the inlet throttle (70) are dimensioned such that when the outlet throttle (72) is open, more fuel flows out of the control chamber (50) than flows to it through the inlet throttle (70), and a connection (55) between the control chamber (50) and the control pressure chamber (52), the control pressure chamber (52) being closed off except for the connection (55), and the connection (55) is dimensioned such that upon opening of the outlet throttle (72) by the control valve (58), the pressure first drops in the control chamber (50) and only drops in the control pressure chamber (52) as well after a time lag.

2. The fuel injection valve of claim 1, wherein the control valve (58) further comprise a valve chamber (68) communicating with the control chamber (50) and a valve member (60) that is controllable by an actuator (46).

3. The fuel injection valve of claim 2, wherein the valve member (60) of the control valve (58) is moved by means of an electric actuator (46).

4. The fuel injection valve of claim 3, wherein the electric actuator (46) is a piezoelectric actuator.

5. The fuel injection valve of claim 2, wherein the valve member (60), in a first switching position, cooperates with a first valve seat (62) and, in a second switching position, cooperates with a second valve seat (64), and the valve chamber (68), in the first switching position, is sealed off from the leak fuel chamber (78) and, in the second switching position, communicates with the leak fuel chamber (78).

6. The fuel injection valve of claim 5, wherein the valve chamber (68) can be made to communicate with the high-pressure conduit (10) via a connecting conduit (74; 76), and upon its contact with the second valve seat (64), the valve member (60) closes the connecting conduit (74).

7. The fuel injection valve of claim 5, wherein the valve member (60) can be put into a middle position, so that the valve member (60) rests on neither the first valve seat (62) nor the second valve seat (64).

8. The fuel injection valve of claim 1, further comprising an outer pressure piston (40) disposed in the housing (1), which pressure piston (40) is connected to the outer valve needle (20) and whose end face (51) defines the control chamber (50), 50 that by means of the hydraulic force on this end face (51), a closing force is exerted on the outer valve needle (20).

9. The fuel injection valve of claim 8, wherein the outer pressure piston (40), in the opening motion of the outer valve needle (20), comes to rest on one wall of the control chamber (50) and thereby interrupts the inlet throttle (70) that connects the control chamber (50) with the high-pressure conduit (10).

10. The fuel injection valve of claim 8, wherein the control pressure chamber (52) is embodied in the outer pressure piston (40), and wherein the connection with the control chamber (50) is embodied as a connecting bore (55) in the outer pressure piston (40).

11. The fuel injection valve of claim 1, wherein a pressure, preferably atmospheric pressure, that is markedly lower than the injection pressure always prevails in the leak fuel chamber (78).

* * * * *